US012582884B2

(12) United States Patent
Steel et al.

(10) Patent No.: US 12,582,884 B2
(45) Date of Patent: Mar. 24, 2026

(54) BALL BAT HAVING VARIABLE WALL THICKNESS

(71) Applicant: Wilson Sporting Goods Co., Chicago, IL (US)

(72) Inventors: John P. Steel, Carmichael, CA (US); Ninad Trifale, Chicago, IL (US); Robert A. Lairmore, Oceanside, CA (US); James M. Earley, Roseville, CA (US); Jeremy H. Yim, Rocklin, CA (US); Sean P. Griffin, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 674 days.

(21) Appl. No.: 17/993,111

(22) Filed: Nov. 23, 2022

(65) Prior Publication Data

US 2024/0165469 A1 May 23, 2024

(51) Int. Cl.

| | |
|---|---|
| ***A63B 59/58*** | (2015.01) |
| ***A63B 59/51*** | (2015.01) |
| ***A63B 59/56*** | (2015.01) |
| ***A63B 102/18*** | (2015.01) |

(52) U.S. Cl.

CPC ..... *A63B 59/58* (2015.10); *A63B 59/51* (2015.10); *A63B 59/56* (2015.10); *A63B 2102/18* (2015.10)

(58) Field of Classification Search

CPC ..... A63B 59/58; A63B 59/51; A63B 59/56; A63B 2102/18; A63B 59/50; A63B 2102/182; A63B 2209/00

See application file for complete search history.

(56) References Cited

U.S. PATENT DOCUMENTS

| | | | | |
|---|---|---|---|---|
| 5,094,453 | A | 3/1992 | Douglas | |
| 5,961,405 | A * | 10/1999 | MacKay, Jr. | A63B 59/51 473/566 |
| 6,139,451 | A | 10/2000 | Hillerich, III | |
| 6,949,038 | B2 | 9/2005 | Fritzke | |
| 7,175,552 | B2 | 2/2007 | Fritzke | |
| 8,062,154 | B2 * | 11/2011 | Burger | A63B 59/50 473/567 |
| 8,066,838 | B1 | 11/2011 | Burger | |
| 9,186,563 | B2 | 11/2015 | Burger | |
| 11,325,327 | B2 | 5/2022 | Yim | |
| 11,364,425 | B1 * | 6/2022 | Hodge | A63B 60/12 |
| 11,771,962 | B2 | 10/2023 | Griffin | |
| 11,890,517 | B2 | 2/2024 | Yim | |
| 11,986,707 | B2 | 5/2024 | Griffin | |
| 2012/0231904 | A1 | 9/2012 | Fonte | |
| 2019/0224544 | A1 * | 7/2019 | Stenzler | A63B 60/52 |

* cited by examiner

*Primary Examiner* — Jeffrey S Vanderveen

(74) *Attorney, Agent, or Firm* — Terence P. O'Brien; Todd A. Rathe

(57) ABSTRACT

A ball bat may include a handle portion and a barrel portion extending away from the handle portion to an end cap. The barrel portion has an outer wall formed from aluminum and includes at least two and no greater than four inwardly projecting circumferential humps spaced by intervening circumferential valleys.

14 Claims, 6 Drawing Sheets

BALL BAT HAVING VARIABLE WALL THICKNESS

BACKGROUND

Baseball and softball are very popular sports in the United States, Japan, Cuba, and elsewhere. Ball bats impart or receive impact forces upon impacting a ball and transmit the shock and vibrations from the impact through the handle of the bat to the hands of the batter. Impacts occurring away from the "sweet spot" of the ball bat generally result in greater shock and vibrational energy transferring to the batter's hands. Many batters find such shock and/or vibrational energy to be uncomfortable and/or painful. Some players refer to this event as being "stung" by the bat.

Baseball and softball organizations periodically publish and update equipment standards and/or requirements including performance limitations for ball bats. As a result, the maximum performance level of high-end ball bats used in organized, competitive play are designed not to exceed applicable performance limits. A continuing need exists to provide a ball bat that provides a high level of performance over a large area of the barrel portion of the bat.

Figure 1A:
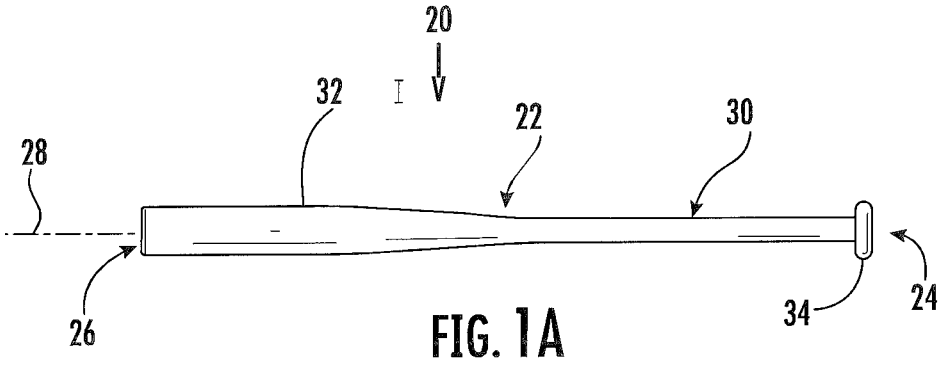
FIG. 1A is a perspective view of an example ball bat having one piece integrally formed bat frame.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example ball bats that may provide enhanced performance while satisfying existing ball bat standards and requirements. Ball bats used in official high school and college baseball competitions may be regulated according to a protocol known as the NCAA Standard for Testing Baseball Bat Performance Bat-Ball Coefficient of Restitution (BBCOR) which was most recently updated as of Sep. 1, 2018. Under this protocol, ball bats must be designed so that the performance remains BBCOR compliant throughout the life of the bat. To be deemed as compliant, non-wood bats must undergo a certification process and be listed on the NCAA's BBCOR approved bat list. To be BBCOR compliant, a ball bat must not exceed a BBCOR value of 0.500 and must have a weight that is at least 3 ounces less than the length of the bat. For example, a bat that is 32 inches long cannot have a weight of (32-3) 29 ounces.

The disclosed example ball bats have a configuration that provides a BBCOR value closest to the 0.500 BBCOR limit over a larger area of the barrel portion of the ball bat. As a result, enhanced power is provided over a larger area of the bat. The example ball bats achieve the larger BBCOR limit approaching region by varying the thickness of the wall of an aluminum bat so as to provide the barrel portion of the aluminum bat with at least two and no greater than four inwardly projecting circumferential humps spaced by intervening circumferential valleys and located within 10 inches of an axial distal end of the barrel portion. Such ball bats additionally comply with the aforementioned weight and length restrictions for a sanctioned ball bat.

In the example illustrated, at least one of the inwardly projecting circumferential humps has a maximum thickness that is axially located between the location at which the hollow interior of the barrel portion is closed (the distal end with an inserted endcap) and the beginning of what is considered to be the "sweet spot" of the barrel. In the examples illustrated which include such an endcap, at least one of the inwardly projecting circumferential humps has a maximum thickness axially spaced at least 1.5 inches from an axial distal end of the barrel portion and no greater than 4 inches from the axial distal end of the barrel portion of the ball bat.

The provision of the inwardly projecting circumferential hump outside of the sweet spot and proximate the axial distal end of the bat may contradict much of the prevailing traditional bat design approaches. Such traditional bat design approaches typically add weight to the bat at locations closer to the handle to make the bat easier to swing. Such traditional bat design approaches consider the first 3 to 4 inches at the axial distal end of the bat to be a lower performing portion of the bat barrel such that increasing the wall thickness in such regions would only further decrease the performance of the bat at such locations. Additionally, conventional bat design would tend to avoid increasing the wall thickness of the barrel portion of the bat near the distal end of the bat because such wall thickness would increase the weight of the bat toward its distal end, which can reduce swing speed and increase the bat's moment of inertia. However, in contrast to such prevailing traditional bat design considerations, it has been found that providing a first inwardly projecting circumferential hump outside of the sweet spot and proximate the axial distal end of the barrel portion of the bat and providing a second inwardly projecting circumferential hump within the sweet spot extends the BBCOR limit approaching region of the ball bat. As a result, the barrel portion of the aluminum bat has a larger region that provides enhanced power and hitting performance.

The increased BBCOR limit approaching region of the ball bat is believed to partially be the result of the nonuniform wall thickness variation along the barrel portion of the bat. In some implementations, additional inwardly projecting circumferential humps may be provided at various locations so long as such humps have non-uniformly spaced locations in that the humps are not part of a series of uniformly spaced grooves or a part of one or more helical grooves extending from a location within the first 4 inches of the distal and of the barrel portion into the sweet spot of the ball bat. For example, the barrel portion of the ball that may include up to four projecting circumferential humps along the barrel portion of the bat. It is anticipated that greater than four of such humps, such as those in a series of uniformly spaced grooves, may work against the intended extension of the BBCOR limit approaching region of the ball bat.

In some implementations, the first inwardly projecting circumferential hump extends adjacent a first circumferential valley that has a first minimum thickness at least 0.2 mm thinner than the first maximum thickness of the first circumferential hump. In some implementations, the inwardly projecting circumferential humps comprise a second circumferential hump, wherein the first circumferential valley extends between the first circumferential hump and the second circumferential hump and wherein the second circumferential hump has a second maximum thickness that is at least 1.5 mm thicker than the first minimum thickness of the first circumferential valley. In some implementations, the ball bat may further comprise a second circumferential valley on a side of the first circumferential hump opposite the first circumferential valley. In some implementations, the first circumferential hump has a continuously variable thickness extending from a first end of the first circumferential hump proximate the axial distal end of the barrel portion to a second end of the first circumferential hump proximate the handle portion. In some implementations, the first circumferential hump has a thickness that axially tapers from the first maximum thickness to the first circumferential valley and wherein the second circumferential hump has a thickness that axially tapers from the second maximum thickness to the first circumferential valley.

In some implementations, the ball bat has a bat-ball coefficient of restitution (BBCOR) that satisfies the National Collegiate Athletic Association (NCAA) BBCOR competition standard, a BBCOR value of no greater than 0.500. In such implementations, the ball bat may have a length of X inches and a weight of (X−3) ounces.

In some implementations, the ball bat may comprise a circumferential groove between the inwardly projecting circumferential humps and the axial end of the barrel portion and a portion of the endcap can be inserted into the circumferential groove.

In some implementations, the inwardly projecting circumferential humps comprise a first circumferential hump has a first maximum thickness and a second circumferential hump having a second maximum thickness that is at least 1.5 mm thicker than the first maximum thickness. In some implementations, the ball bat may comprise a circumferential valley between the inwardly projecting circumferential humps and the axial distal end of the barrel portion. In some implementations, the inwardly projecting circumferential humps comprise a circumferential hump having a continuously variable thickness extending from a first end of the first circumferential hump proximate the axial distal end of the barrel portion to a second end of the first circumferential hump proximate the handle portion.

In some implementations, the handle portion and the barrel portion are integrally formed as part of a single unitary body formed of a metallic alloy, such as an aluminum alloy (referred to as aluminum). In other implementations, other forms of aluminum or metallic alloys can be used, such as, for example, a titanium alloy or a carbon steel alloy. In some implementations, the handle portion can be distinct from the barrel portion and can be joined or coupled to the barrel portion.

FIG. 1A is a perspective view illustrating an example ball bat 20. Ball bat 20 may provide enhanced performance while satisfying existing ball bat standards and requirements. Ball bat 20 has a configuration that provides a BBCOOR value closest to the 0.500 BBCOR limit over a larger area of the barrel portion of the ball bat. As a result, enhanced power is provided over a larger area of the bat. Ball bat 20 achieves the larger BBCOR limit approaching region by varying the thickness of the wall of an aluminum bat so as to provide the barrel portion of the aluminum bat with at least two and no greater than four inwardly projecting circumferential humps spaced by intervening circumferential valleys and located within 10 inches of an axial distal end of the barrel portion. Ball bat 20 extends from a knob end 24 to a distal axial end 26 along a longitudinal axis 28. Ball bat 20 comprises handle portion 30 and the barrel portion 32. Handle portion 30 terminates at a knob 34 and extends from knob 34 to barrel portion 32, generally widening as it approaches barrel portion 32. Barrel portion 32 extends from handle portion 30 to its axial distal end 26. In the example illustrated, distal end 26 has a an inwardly tapered axial edge. In other implementations, distal axial end 26 may omit the inward taper or may have other shapes. The barrel portion 32 is integrally formed with the handle portion 30 as a single unitary body or bat frame 22 formed from a metal, such as aluminum.

Figure 1B:
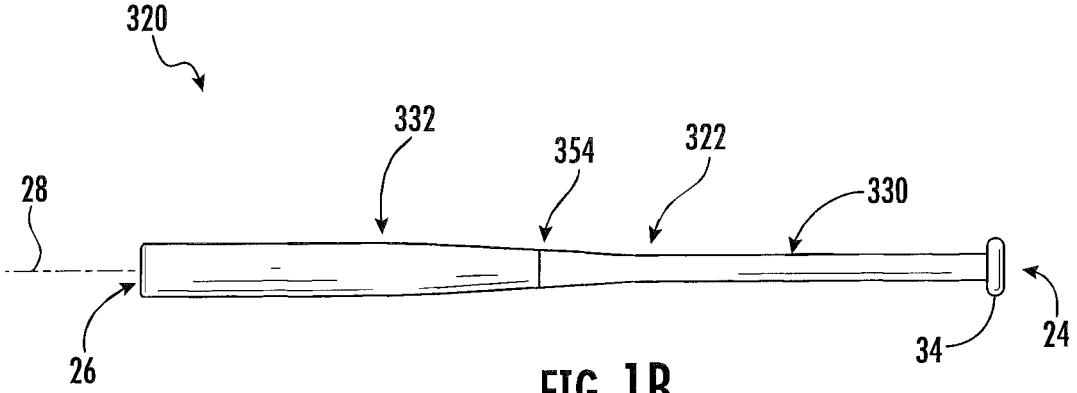
FIG. 1B is a perspective view of another example ball bat having a barrel portion and a separate handle portion.

FIG. 1B is a perspective view illustrating another example ball bat 320. Like ball bat 20, ball bat 320 may provide enhanced performance while satisfying existing ball bat standards and requirements. Ball bat 320 has a configuration that provides a BBCOR value closest to the 0.500 BBCOR limit over a larger area of the barrel portion of the ball bat. As a result, enhanced power is provided over a larger area of the bat. Ball bat 320 achieves the larger BBCOR limit approaching region by varying the thickness of the wall of an aluminum bat so as to provide the barrel portion of the aluminum bat with at least two and no greater than four inwardly projecting circumferential humps spaced by intervening circumferential valleys and located within 10 inches of an axial distal end of the barrel portion. Ball bat 320 is substantially the same as ball bat 20 except that ball bat 320 is formed from a bat frame 322 having a separate barrel portion 332 and a handle portion 330. The separate barrel and handle portions 332 and 330 can be fitted, bonded or otherwise coupled together. A proximal end 354 of the barrel portion 330 is illustrated. The barrel portion 332 like the barrel portion 32 is formed of aluminum or other alloy. The handle portion 332 can be formed from aluminum, a fiber composite material, other alloys, wood, a thermoplastic material, a thermoset material, or combinations thereof.

For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Figure 2:
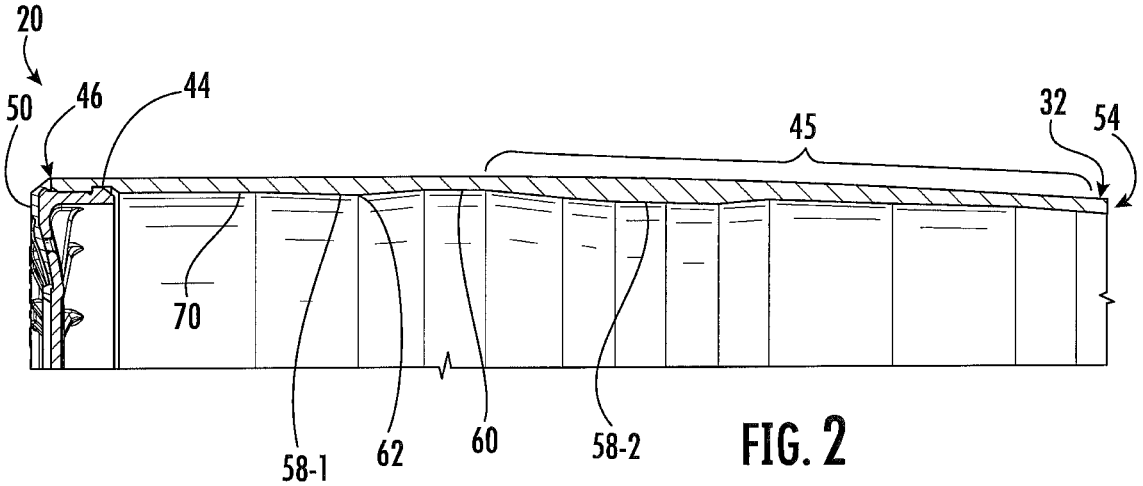
FIG. 2 is a fragmentary sectional view of a barrel portion and end cap of the example ball bat of FIG. 1.
Figure 3:
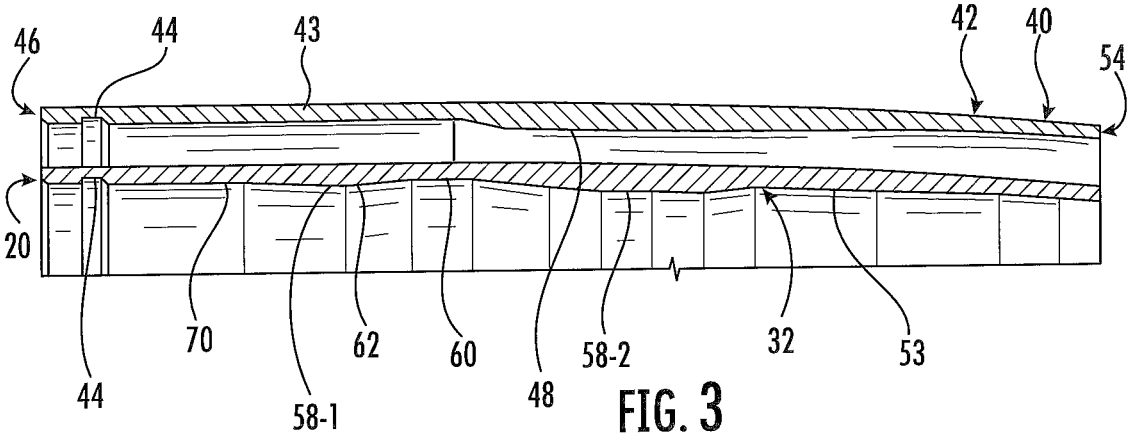
FIG. 3 is a fragmentary sectional view of the barrel portion of FIG. 2 overlaid with respect to a sectional view of a barrel portion of a second example ball bat for direct comparison of their different thickness profiles.

FIGS. 2 and 3 are sectional views of barrel portion 32 of ball bat 20. FIGS. 2 and 3 are also applicable to ball bat 320. FIG. 3 illustrates a sectional view of the barrel portion 32 of bat 20 overlaid with respect to a sectional view of a barrel portion 42 of an existing commercially available ball bat 40 for a direct comparison of the thickness profiles of the different barrel portions. Ball bat 40 may be similar to ball bat 20 but for its barrel portion 42. Barrel portion 42 has an outer wall 43 that has a substantially uniform thickness in the region extending from circumferential groove 44 to the beginning of a high performance region of the barrel portion 32, commonly referred to as the sweet spot 45, which has an increased or enlarged thickness (beginning approximately 4.2 inches from the axial end 46 of barrel portion 42 and extending towards the knob end 24). In ball bat 40 of FIG. 3, the outer wall 43 is also the only wall. Circumferential groove 44 is sized to receive an end cap 50 (shown in FIG. 2) proximate the axial end 46. Outer wall 43 comprise a single inwardly projecting circumferential hump 48 located within the sweet spot 45 of barrel portion 42.

Barrel portion 32 of ball bat 20 has an outer wall 53 formed from a metal, such as aluminum, which continuously extends from a proximal region 54 to an axial distal end 46 of barrel portion 32. Like barrel portion 42 of bat 40, barrel portion 32 includes a circumferential groove 44 receiving end cap 50. Also, like bat 40, ball bat 20 of FIGS. 2 and 3, has a single wall referred to as the outer wall 53. Circumferential groove 44 begins approximately 0.4 inches from the axial end 46 and extends to the right (as shown in FIG. 2) for approximately 0.2 inches.

In the example illustrated, end cap 50 snaps into groove 44 and projects beyond the axial distal end 46 of the barrel portion 32, closing off the open-ended hollow interior of barrel portion 32. In other implementations, end cap 50 may be secured to barrel portion 32 in other fashions. For example, adhesives may additionally be used to further secure end cap 50 in place. In some implementations, circumferential groove 44 may be omitted or other mounting interlocks or structures may be employed. For example, in some implementations, the axial distal end of barrel portion 32 may be integrally bent or curled to facilitate retention of end cap 50. In some implementations, end cap 50 may alternatively be recessed within the axial distal end 46 of the barrel portion 32 when mounted to barrel portion 32. In yet other implementations, barrel portion 32 may be integrally formed as part of a single unitary body with an end that closes off the axial end of ball bat 20.

As shown by FIG. 3, in contrast to the outer wall 43 of barrel portion 42, outer wall 53 of barrel portion 32 comprises at least two and no greater than four inwardly projecting circumferential humps, wherein each adjacent pair of humps 58 is spaced by an intervening circumferential valley and located within 10 inches of an axial distal end 46 of barrel portion 32. In the example illustrated, outer wall 53 of barrel portion 32 comprises a first inwardly projecting circumferential hump 58-1 and a second inwardly projecting circumferential hump 58-2 spaced by an intervening circumferential valley 60.

Humps 58-1 and 58-2 project inwardly towards the axial center line from the outer surface of barrel portion 32 such that those regions of barrel portion 32 have an increased thickness relative to surrounding regions of barrel portion 32. Hump 58-1 has a maximum thickness axially spaced at least 1.5 inches from the axial distal end 46 of barrel portion 32. Hump 58-1 is separated from hump 58-2 by valley 60 which has a minimum thickness of at least 0.2 mm thinner than the maximum thickness of hump 58-1. Both hump 58-1 and valley 60 are located outside of the sweet spot 45 of barrel portion 32, both humps being located between the axial distal end of sweet spot 45 (4.2 inches from the axial distal end 46) and the axial distal end 46 of barrel portion 32.

Hump 58-2 is located within sweet spot 45. Hump 58-2 has a maximum thickness that is at least 1.5 mm thicker than the minimum thickness of valley 60. In the example illustrated, hump 58-2 has a maximum thickness that extends from a location 5.5 inches from the axial distal end 46 to a location 6.5 inches from the axial distant end 46.

Figure 4:
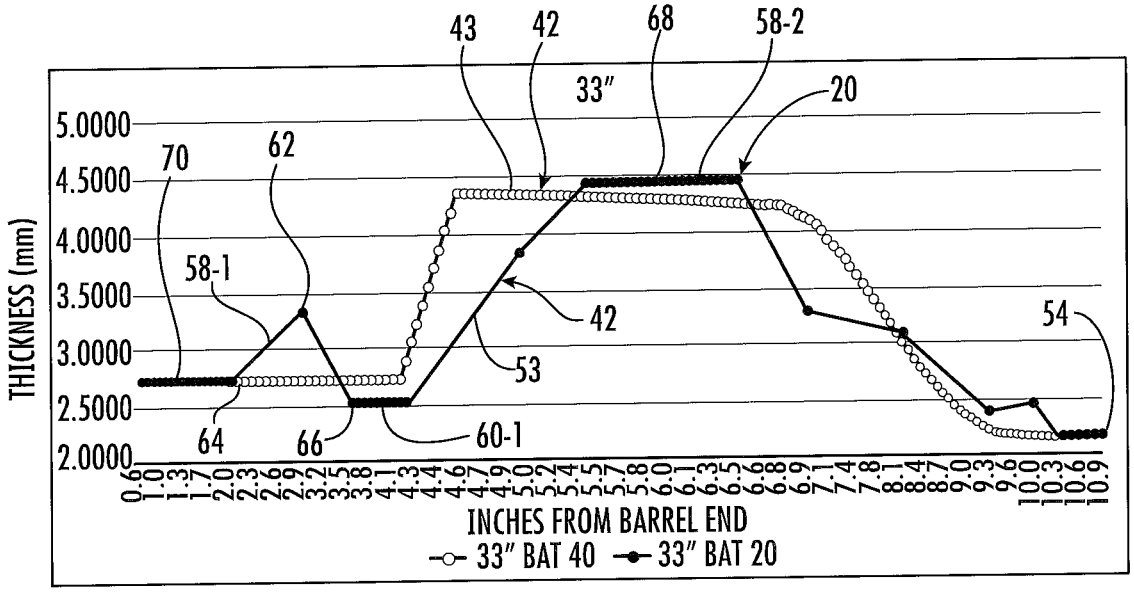
FIG. 4 is a graph of the different thickness profiles of the ball bats of FIG. 3.

FIG. 4 is a graph illustrating one example thickness profile for barrel portion 32 relative to barrel portion 42 for ball bats 20 and 40 that are each 33 inches long. FIG. 4 illustrates the thickness profiles of outer walls 43 and 53 of barrel portions 32 and 42 along the length of barrel portion 32 and 42, respectively, with the X axis or abscissa beginning 0.6 inches from the axial distal end 46 of such barrel portions. In other words, the "X (inches)" where the X axis begins is at a location 0.6 inches from the axial end of the barrel shown in FIGS. 2 and 3, a location just to the right of groove 44 as seen in FIGS. 2 and 3.

As shown by FIG. 4, hump 58-1 has a maximum thickness located at a peak 62 which is no greater than 3.5" from the axial distal end 46 of barrel portion 32 of bat 20. Hump 58-1 has a continuously variable thickness along the length extending from a first end 64 to a second end 66, which is the beginning of valley 60. In the example illustrated, hump 58-1 has a thickness that axially tapers from peak 62, the first maximum thickness, to the circumferential valley 60. On an opposite side, hump 58-1 has a thickness that also axially tapers from peak 62 towards the axial distal end 46, ending at a second valley 70 which extends on an opposite side of hump 58-1 as valley 60. Similarly, hump 58-2 has a thickness that axially tapers from its maximum thickness 68 to the circumferential valley 60.

In the example illustrated, valley 70 has a thickness of 2.72 mm, peak 62 is no greater than 3 inches (3.0 inches) from the axial end 46 of barrel portion 32 and has a thickness of 3.33 mm, valley 60 has a thickness of 2.51 mm and hump 68 has a thickness of 4.45 mm. As shown by FIG. 4, barrel portion 32 begins to taper in a stepwise manner from hump 58-2 to the proximal end 54 of barrel portion 32.

Figure 5:
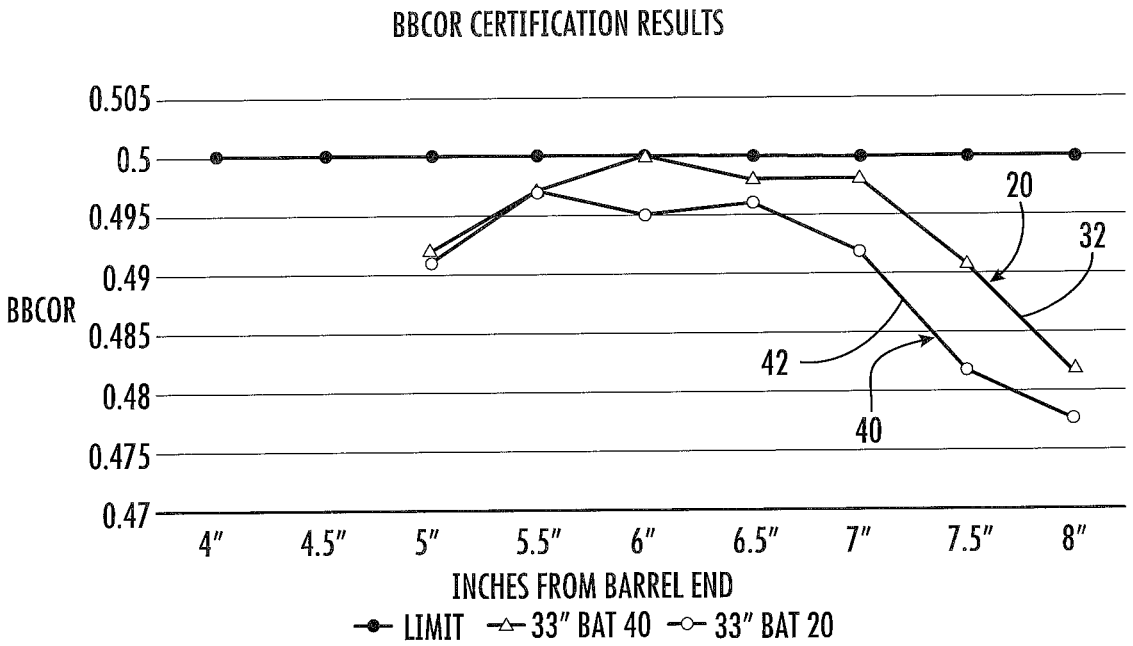
FIG. 5 is a graph of the different bat-ball Coefficient of Restitution (BBCOR) certification result along a length of the barrel portions of the bats of FIG. 3.

FIG. 5 is a graph comparing BBCOR certification results for bats 20 and 40 described with respect to FIGS. 1-4. FIG. 5 is a graph illustrating BBCOR measurements or values taken at distinct axial locations at different distances from the axial distal end 46 of such ball bats 20, 40. The BBCOR values were obtained as part of official NCAA testing at Washington State University using the following testing protocol as set forth in the NCAA Standard for Testing Baseball Bat Performance Bat-Ball Coefficient of Restitution (BBCOR) (the complete testing protocol of which is hereby incorporated by reference).

Testing Protocol

Test Apparatus

A bat test apparatus, consisting of an air cannon, ball speed gate, bat pivot with speed measurement and environmental control as described in ASTM F2219.

A load frame and anvils capable of measuring barrel compression according to ASTM F2844.

Standard Bat Calibration

The purpose of the Standard Bat is to ensure test uniformity over time and between laboratories. Standard Bats shall have a length 34±0.07 in, inertia 11,250±100 oz in$^2$ (ASTM F2398), wall thickness at 6 inches from the endcap of 0.165±0.003 in, and a BBCOR of 0.495±0.005. To reduce variation, Standard Bats are impacted at the identified circumferential location, and not rotated between impacts.

The BBCOR of a Standard Bat is established from 48 baseballs. To calibrate a Standard Bat, a new and existing Standard Bat are each impacted at 6 inches from the endcap with 24 different baseballs. The groups of 24 balls are then exchanged between the new and existing Standards Bats for an additional 24 impacts on each bat. The calibrated BBCOR of the new Standard Bat, $e_n$, is found from $$e_n = e_e - \bar{e}_e + \bar{e}_n \tag{1a}$$

where $e_e$ is the original calibrated BBCOR of the existing Standard Bat, and $\bar{e}_n$ and $\bar{e}_e$ are the average BBCOR from the 48 impacts with the new and existing Standard Bats, respectively.

$C_{ball}$ Bat Calibration $C_{ball}$ Bats shall have the same design as the Standard bat and are used for test ball preparation. To reduce variation, $C_{ball}$ Bats are impacted at the identified circumferential location, and not rotated between impacts.

The BBCOR of a $C_{ball}$ Bat is established from 48 baseballs. To calibrate a $C_{ball}$ Bat, it and a Standard Bat are impacted at 6 inches from the endcap with 24 different baseballs. The groups of 24 balls are then exchanged between the $C_{ball}$ and Standards Bats for an additional 24 impacts on each bat. The calibrated BBCOR of the $C_{ball}$ Bat, $e_c$, is found from $$e_c = e_n - \bar{e}_n + \bar{e}_c \tag{1b}$$

where $e_n$ is the calibrated BBCOR of the Standard Bat, and $\bar{e}_n$ and $\bar{e}_c$ are the average BBCOR from the 48 impacts with the Standard and $C_{ball}$ Bats, respectively. $C_{ball}$ bats are to be recalibrated annually.

Performance Calculations

Calculate the uncorrected bat-ball coefficient of restitution, e, using $$e = \frac{v_R}{v_I}(1 + r) + r \tag{2}$$

where r is $$r = m\left[\frac{1}{W} + \frac{(L - BP - z)^2}{1 - W(BP - 6)^2}\right] \tag{3}$$

and where, m is the weight of the ball; $v_I$ and $v_R$ are the ball inbound and rebound speeds, respectively; W is the weight of the bat, I is the moment of inertia of the bat, and z is the impact location relative to the endcap of the bat.

Calculate the corrected bat-ball coefficient of restitution, BBCOR, using $$\text{BBCOR} = e + C_{ball} + C_{lot} \tag{4}$$

where $C_{ball}$ and $C_{lot}$ are defined in "Test Ball Preparation."

Test Ball Preparation

Test balls shall have lot correction to account for changes in ball performance with use. A ball lot is defined by its date code. (The date code is typically found to the right of the "NCAA" logo near the seam. It is a 5-character code with numbers and letters.) For each lot, 1% of balls will be randomly selected and impacted 20 times at 136±1 mph against the $C_{ball}$ Bat. Results from balls that yield less than 15 valid hits will be discarded. The average performance of the first four impacts, $e_{1\text{-}4}$, will be compared to the average performance of impacts 5-20, $e_{5\text{-}20}$, to obtain a lot correction factor, $C_{lot}$, as $$C_{lot} = e_{1\text{-}4} - e_{5\text{-}20}$$

and shall be recorded.

Test balls shall be impacted at 6 in. from the endcap against a $C_{ball}$ Bat, as described in ASTM F2219. The $C_{ball}$ Bat shall be impacted at the certified circumferential location, and not rotated between impacts.

Test balls shall be Rawlings Model FSR1NCAA baseballs. Each ball shall be impacted at a speed of 136±1 mph until two valid impacts are achieved; the results are calculated using Eq. 2 and denoted $e_1$ and $e_2$, respectively. Mark the ball surface to track the number of impacts. If $|1-2|>0.005$ the result of neither impact is used, and the ball is either retested or discarded.

The test date and correction factor, $C_{ball}$, defined by $$C_{ball} = e_c - e \tag{5}$$

shall be recorded on each test ball.

Test Bat Preparation

Record Model Name and Model Number

1. Verify the maximum barrel diameter by passing the bat through a ring that is 1 in. long and of inside diameter 2.655±0.003 in.
2. Measure the bat length, L (in), weight, W (oz), and maximum barrel diameter (in).
3. For length classification, round the bat length, L, to nearest ½ in. to obtain Lc.
4. Verify that W–Lc>–3.0.
5. Measure the moment of inertia, I (oz in$^2$), and balance point, BP (in), according to ASTM F2398.
6. Verify that I>0.0278 $Lc_{3.615}$.
7. If the bat barrel contains a composite material or shows increased performance with use (as determined by the NCAA)[2], it is deemed a "composite bat", and the initial barrel compression is measured according to ASTM F2844. If the bat has a ring (or similar stiffening device) at the 6-inch location, changes in barrel compression may be observed at another barrel location.

Bat Testing Procedure

1. Mount the bat into the grip as described in F2219. The grip may include a compliant material between the clamps and the bat to allow for the rotation of the bat in the grip between hits.
2. Select a test ball. Test balls must have less than 20 impacts (5 per ear), at least a 4-hour rest between impacts and weigh 5.13±0.07 oz. Mark the ball impact surface to track the number of ball impacts.
3. Select the impact location, z, relative to the distal end of the bat. Set the ball cannon to fire the ball at a target speed, $V_T$, of $$V_T = 66\left(\frac{L - 6 - z}{L - 12}\right) + 70 \tag{6}$$

4. Accept only impacts where $|V_T - V_i| \leq 1$ mph and which meet the criteria described in ASTM F2219.
5. Rotate non-wood bats between impacts unless the bat has a designated impact orientation.
6. The BBCOR at each location is the average of six valid impacts at that location.
7. Identify the maximum performance location by moving the impact location in ½ in. increments. Bats with a ring (or similar stiffening device) in the barrel must be scanned on both sides of the ring. The minimum BBCOR on either side of the peak must be at least 0.003 less than the peak BBCOR.

Pass Criteria

1. The peak BBCOR must be less than or equal to 0.500.
2. The bat must not have evidence of visual damage.
3. The bat inertia must be within 100 oz $in^2$ of that measured in Test Bat Preparation. (interior damage may cause bat inertia to change)
4. The bat must pass the ring test, as described in step 2 of Test Bat Preparation.
5. Composite bats or other designs that show increased performance with use must also undergo the Accelerated Break-In Test Procedure.

As shown by FIG. 5, as compared to bat 40, bat 20 has a BBCOR profile that more closely approximates the 0.500 limit established by the NCAA across a longer axial length or extent of the sweet spot of barrel portion of the ball bats. In the example illustrated, each of the BBCOR measurements at 6 inches from the axial end 46 of bat 20, 6.5 inches from the axial end of the barrel portion 32 of bat 20 and 7 inches from the axial end of the barrel portion 32 of bat 20 more closely approximate the 0.500 BBCOR limit. As a result, bat 20 has enhanced performance over bat 40 and similar bats that may omit the additional hump 58-1 within 3.5 inches from the axial end 46 of the barrel portion 32.

Figure 6:
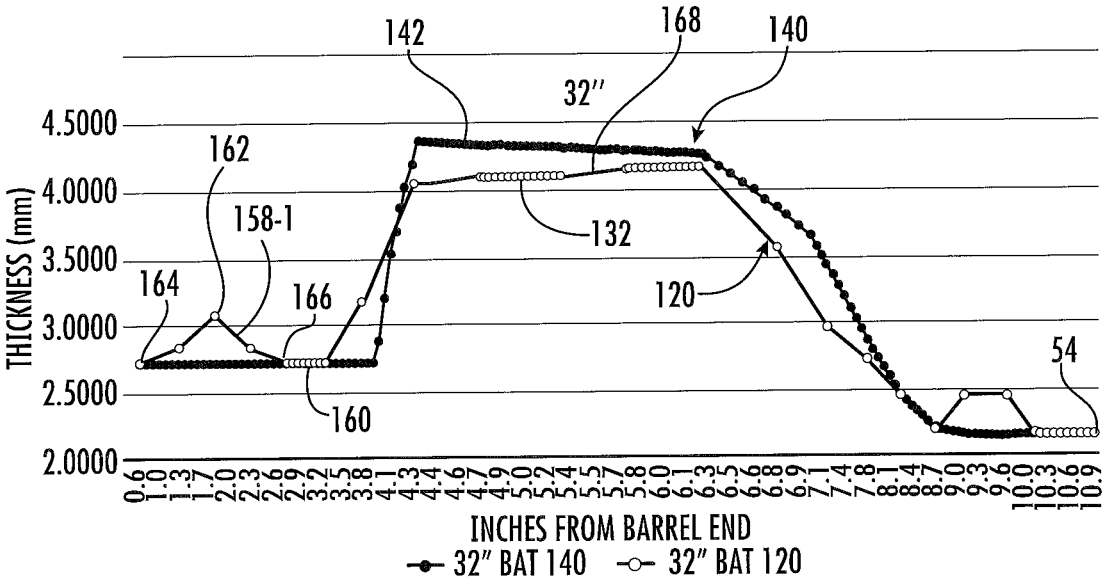
FIG. 6 is a graph of different thickness profiles of two example 32-inch-long ball bats.

FIG. 6 is a graph illustrating one example thickness profile for barrel portion 132 relative to barrel portion 142 for example ball bats 120. The two example ball bats 120 and 140 are similar to ball bats 20 and 40, respectively, except that ball bats 120 and 220 are part of a 32-inch aluminum bat having an end cap 50. FIG. 6 illustrates the thickness profiles of outer walls 143 and 153 of barrel portions 132 and 142 along the length of barrel portion 132 and 142, respectively, from the axial distal end 46 of such barrel portions. As shown by FIG. 6, hump 158-1 has a maximum thickness located at a peak 162 which is no greater than 3.5 inches from the axial distal end of barrel portion 132. Hump 58-1 has a continuously variable thickness along the length extending from a first end 164 to a second end 166, which is the beginning of valley 160. In the example illustrated, hump 158-1 has a thickness that axially tapers from peak 162, the first maximum thickness, to the circumferential valley 160. On an opposite side, hump 158-1 has a thickness that also axially tapers from peak 162 towards the axial distal end 46, ending at the end cap which extends on an opposite side of hump 158-1 as valley 160. Similarly, hump 158-2 has a thickness that actually tapers from its maximum thickness at location 168 to the circumferential valley 160.

In the example illustrated, barrel portion 132 has a thickness of 2.72 mm to the right of groove 44 (shown in FIG. 2), peak 162 is less than 2 inches (1.8 inches) from the axial end 46 and has a thickness of 3.07 mm, valley 160 has a thickness of 2.72 mm and hump 168 has a maximum thickness of 4.14 mm. As shown by FIG. 4, barrel portion 132 begins to taper in a stepwise manner from hump 158-2 to the proximal end 54 of barrel portion 132.

Figure 7:
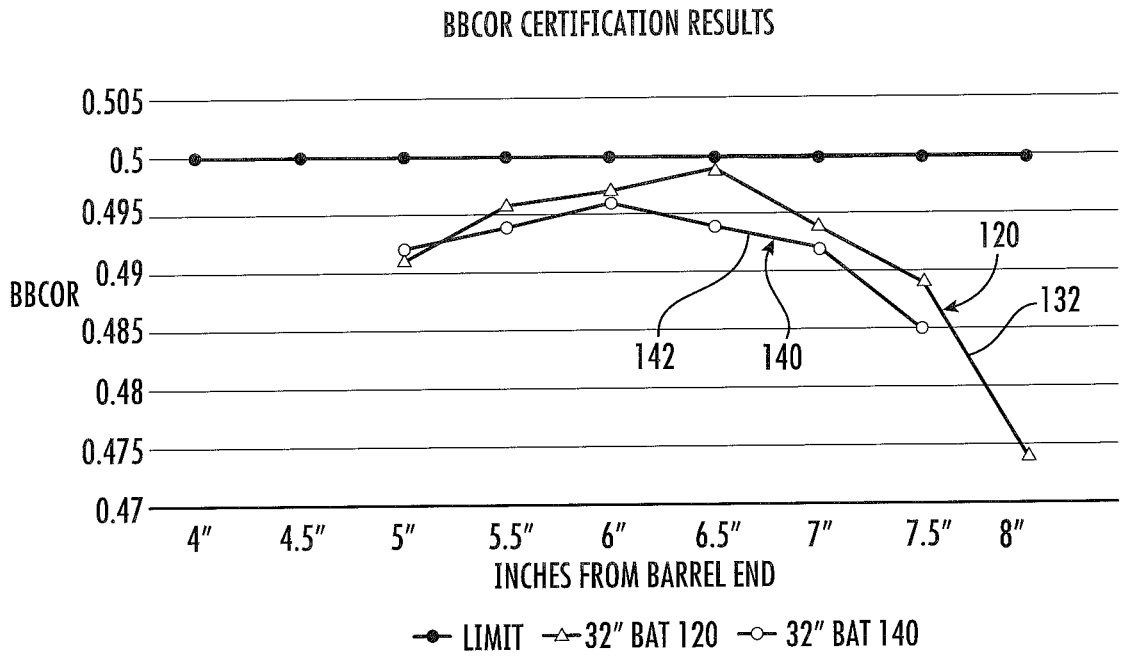
FIG. 7 is a graph of the different BBCOR certification results along the length of the barrel portions of the bats of FIG. 5.

FIG. 7 is a graph comparing BBCOR certification results for the two example ball bats 120 and 140 and their barrel portions 132 and 142, respectively. FIG. 7 is a graph illustrating BBCOR measurements or values taken at distinct axial locations at different distances from the axial end 46 of such ball bats 120, 140. The BBCOR values were obtained as part of official NCAA testing at Washington State University using the above testing protocol as set forth in the NCAA Standard for Testing Baseball Bat Performance Bat-Ball Coefficient of Restitution (BBCOR).

As shown by FIG. 7, as compared to bat 140, bat 120 has a BBCOR profile that more closely approximates the 0.500 limit established by the NCAA across a longer axial length or extent of the sweet spot of barrel portion of the ball bats. In the example illustrated, each of the BBCOR measurements at 5.25 inches from the axial distal end 46, 6 inches from the axial distal end 46, 6.5 inches from the axial distal end 46 of bat 120 and 7 inches from the axial distal end 46 more closely approximate the 0.500 BBCOR limit. As a result, bat 120 has enhanced performance over bat 140 and similar bats that may omit the additional hump 158-1 within 3.5 inches from the axial distal end 46 of the barrel portion 132.

Figure 8:
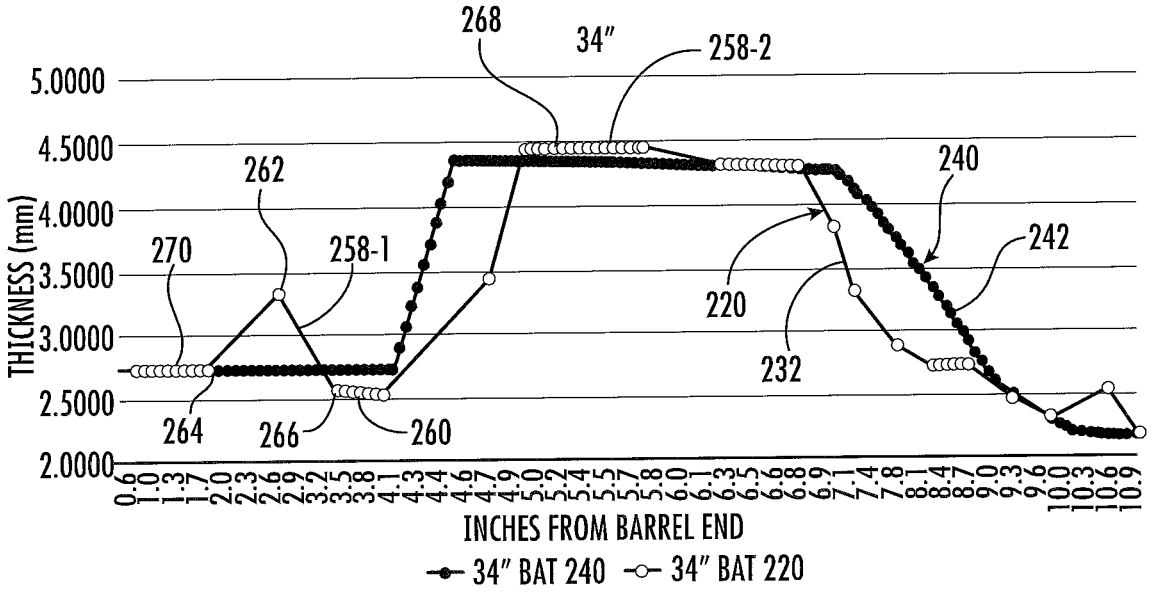
FIG. 8 is a graph of different thickness profiles of two example 34-inch-long ball bats.

FIG. 8 is a graph illustrating one example thickness profile for barrel portion 232 relative to barrel portion 242 for example ball bats 220 and 240 that are each 32 inches long. The two example ball bats 220 and 240 are similar to ball bats 20 and 40, respectively, except that ball bats 220 and 240 are part of a 32-inch aluminum bat having an end cap 50. FIG. 8 illustrates the thickness profiles of outer walls 243 and 253 of barrel portions 232 and 242 along the length of barrel portion 232 and 242, respectively, from the axial distal end 46 of such barrel portions. As shown by FIG. 8, hump 258-1 has a maximum thickness located at a peak 162 which is no greater than 3.5" from the distal axial end of barrel portion 232. Hump 258-1 has a continuously variable thickness along the length extending from a first end 264 to a second end 266, which is the beginning of valley 260. In the example illustrated, hump 258-1 has a thickness that axially tapers from peak 262, the first maximum thickness, to the circumferential valley 260. On an opposite side, hump 258-1 has a thickness that also axially tapers from peak 262 towards the axial distal end 46, ending at the end cap which extends on an opposite side of hump 258-1 as valley 260. Similarly, hump 258-2 has a thickness that axially tapers from its maximum thickness 268 to the circumferential valley 260.

In the example illustrated, barrel portion 232 has a thickness of 2.72 mm proximate the end 46, peak 262 is less than 3 inches (2.8 inches) from the axial end 46 and has a thickness of 3.33 mm, valley 260 has a thickness of 2.54 mm and hump 258-2 has a maximum thickness of 4.45 mm. As shown by FIG. 4, barrel portion 232 begins to taper from hump 258-2 to the proximal end 54 of barrel portion 232.

Figure 9:
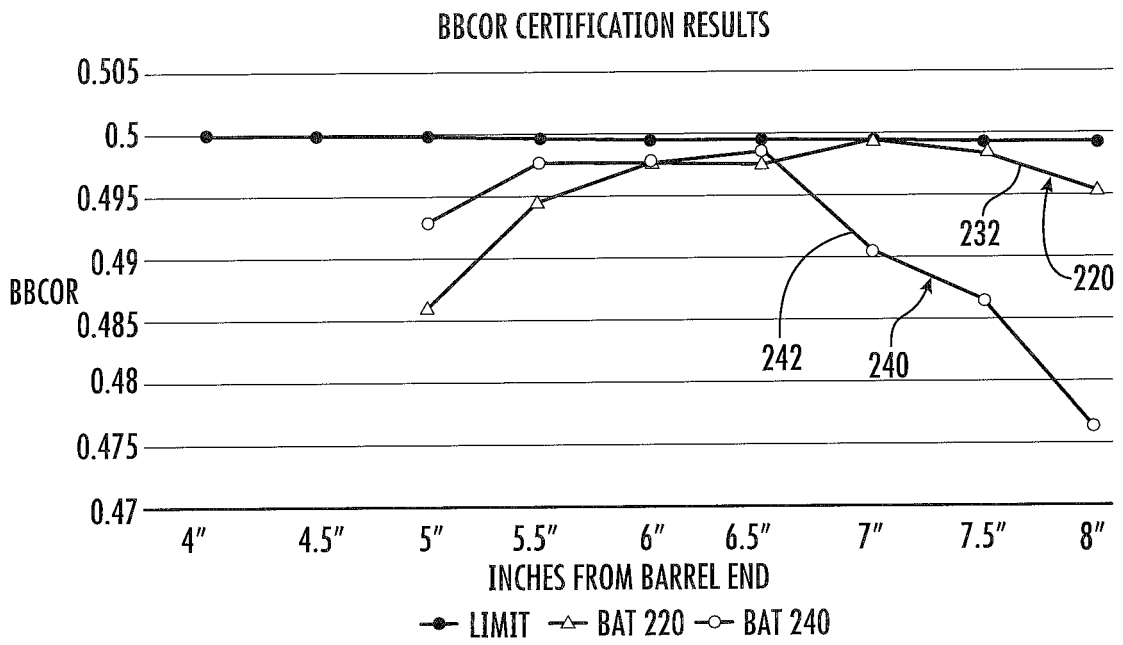
FIG. 9 is a graph of the different BBCOR certification results along the length of the barrel portions of the bats of FIG. 9.

FIG. 9 is a graph comparing BBCOR certification results for the two example ball bats 220 and 240 and their barrel portions 232 and 242, respectively. FIG. 9 is a graph illustrating BBCOR measurements or values taken at distinct axial locations at different distances from the axial end 46 of the barrel portions 232 and 242 of such ball bats 120, 140, respectively. The BBCOR values were obtained as part of official NCAA testing at Washington State University using the above testing protocol as set forth in the NCAA Standard for Testing Baseball Bat Performance Bat-Ball Coefficient of Restitution (BBCOR).

As shown by FIG. 9, as compared to bat 240, bat 220 has a BBCOR profile that more closely approximates the 0.500 limit established by the NCAA across a longer axial length or extent of the sweet spot of barrel portion of the ball bats. In the example illustrated, each of the BBCOR measurements at 5.0-inches from the axial distal end 46, 5.5 inches from the axial distal end 46, 7 inches from the axial distal end 46 and 7.5 inches from the axial distal end 46 more closely approximate the 0.500 BBCOR limit. At 6 inches from the axial distal end 46, the BBCOR values are substantially equal and at 6.5 inches from the axial distal end 46 of bat 220, the BBCOR value of bat 220 is only slightly lower than the BBCOR value of bast 240. As a result, bat 220 has enhanced performance over bat 240 and similar bats that may omit the additional hump 258-1 within 3.5 inches from the end cap of the barrel portion 232.

Figure 10:
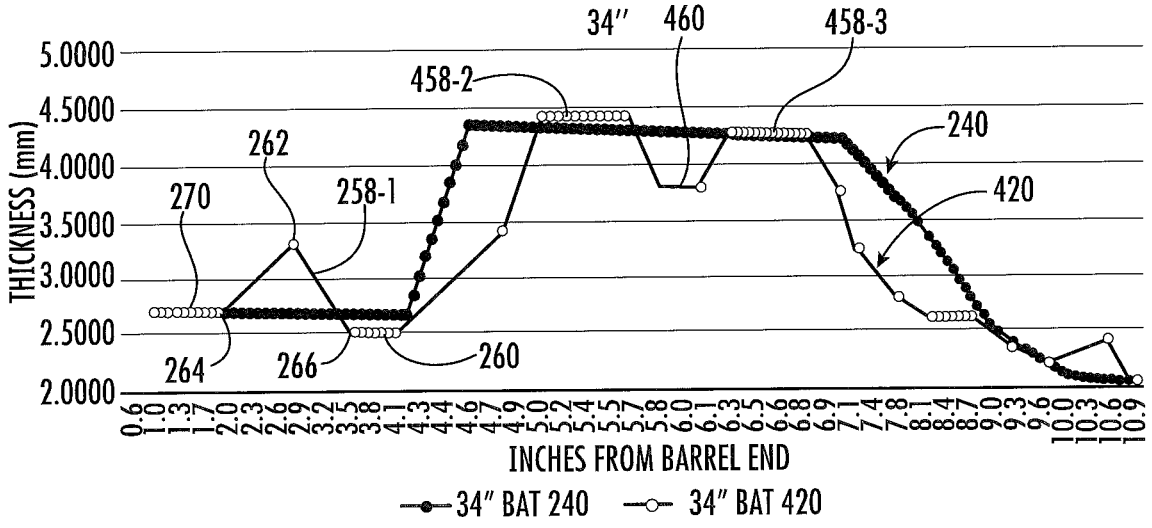
FIG. 10 is a graph of different thickness profiles of two example 34-inch-long ball bats.
Figure 11:
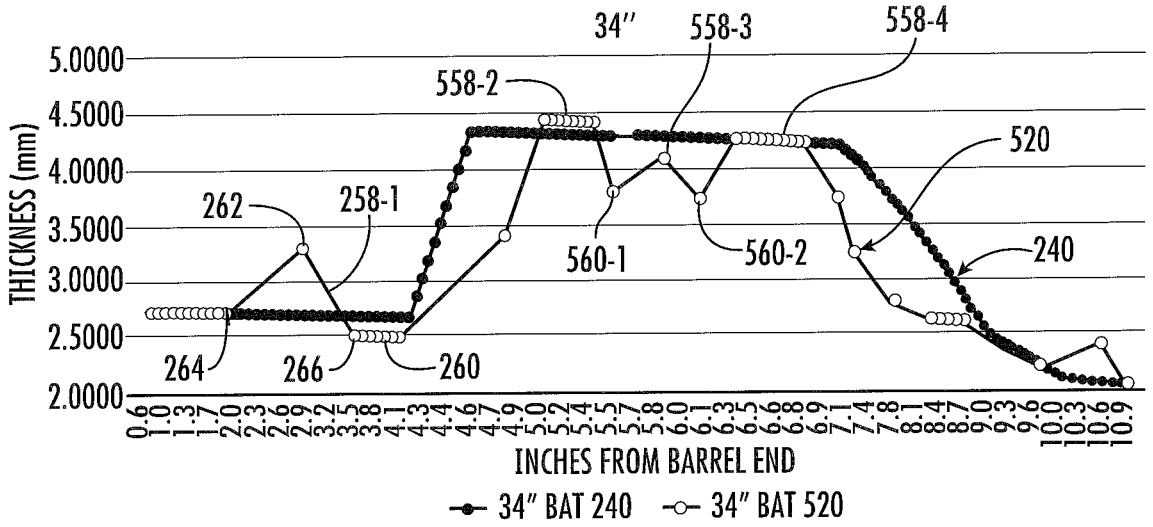
FIG. 11 is a graph of different thickness profiles of two example 34-inch-long ball bats.
Figure 12:
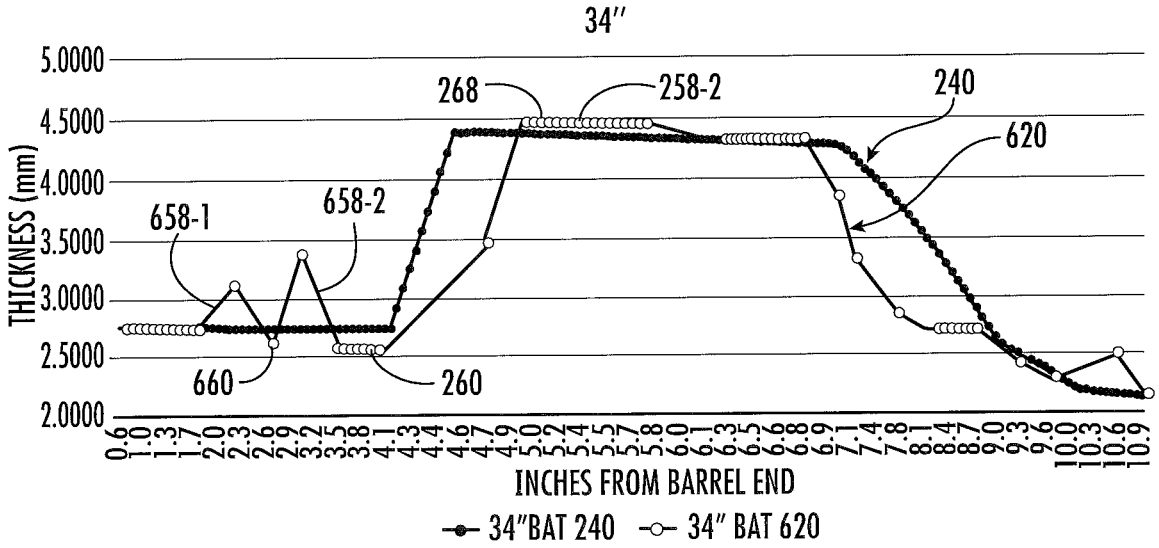
FIG. 12 is a graph of different thickness profiles of two example 34-inch-long ball bats.

FIGS. 10-12 illustrate alternative thickness profiles for the barrel portions of various bats relative to the thickness profile for the 34-inch ball bat 240 first described above with respect to FIGS. 9 and 10. Each of the ball bat FIGS. 10-12 have nonuniform, unequally spaced, and in some cases, unequally sized, inwardly extending circumferential and circumferential valleys between such humps. FIG. 10 illustrates the thickness profile of an example 34-inch ball bat 420. Ball bat 420 is similar to ball bat 220 except that ball bat 420 comprises inwardly extending circumferential humps 458-2 and 458-3 in place of hump 258-2 and additionally includes a circumferential valley 460 between such humps. The remaining portions of the thickness profile of ball bat 420 which correspond to portions of the thickness profile of ball bat 220 are numbered similarly.

FIG. 11 illustrates the thickness profile of an example 34-inch ball bat 520. Ball bat 520 is similar to ball bat 220 except that ball bat 520 comprises inwardly extending circumferential humps 558-2, 558-3 and 558-4 and circumferential valleys 560-1 and 560-2 interspersed between such humps. The remaining portions of the thickness profile of ball bat 520 which correspond to portions of the thickness profile of ball bat 220 are numbered similarly.

FIG. 12 illustrates the thickness profile of an example 34-inch ball bat 620. Ball bat 620 is similar to ball bat 220 except that ball bat 620 comprises inwardly extending circumferential humps 658-1 and 658-2 and circumferential valley 60 between such humps. The remaining portions of the thickness profile of ball bat 620 which correspond to portions of the thickness profile of ball bat 220 are numbered similarly.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A ball bat comprising:

a handle portion; and a barrel portion extending away from the handle portion to an end cap, the barrel portion having an outer wall formed from aluminum and comprising at least two and no greater than four inwardly projecting circumferential humps spaced by intervening circumferential valleys and located within 10 inches of an axial distal end of the barrel portion wherein the inwardly projecting circumferential humps comprise a first circumferential hump having a first maximum thickness axially spaced at least 1.5 inches from the axial distal end.

2. The ball bat of claim 1, wherein the first circumferential hump extends adjacent a first circumferential valley having a first minimum thickness at least 0.2 mm thinner than the first maximum thickness of the first circumferential hump.

3. The ball bat of claim 2, wherein the inwardly projecting circumferential humps comprise a second circumferential hump, wherein the first circumferential valley extends between the first circumferential hump and the second circumferential hump and wherein the second circumferential hump has a second maximum thickness that is at least 1.5 mm thicker than the first minimum thickness of the first circumferential valley.

4. The ball bat of claim 3 further comprising a second circumferential valley on a side of the first circumferential hump opposite the first circumferential valley.

5. The ball bat of claim 4, wherein the first circumferential hump has a continuously variable thickness extending from a first end of the first circumferential hump proximate the axial distal end of the barrel portion to a second end of the first circumferential hump proximate the handle portion.

6. The ball bat of claim 5, wherein the first circumferential hump has a thickness that axially tapers from the first maximum thickness to the first circumferential valley and wherein the second circumferential hump has a thickness that axially tapers from the second maximum thickness to the first circumferential valley.

7. The ball bat of claim 6, wherein the ball bat has a bat-ball coefficient of restitution (BBCOR) that satisfies NCAA BBCOR competition standard, a BBCOR value of no greater than 0.500.

8. The ball bat of claim 7, wherein the ball bat has a length of X inches and a weight of (X-3) ounces.

9. The ball bat of claim 8 further comprising:

a circumferential groove between the inwardly projecting circumferential humps and the axial distal end of the barrel portion; and an endcap inserted into the circumferential groove.

10. The ball bat of claim 1, wherein the inwardly projecting circumferential humps comprise a first circumferential hump has a first maximum thickness and a second circumferential hump having a second maximum thickness that is at least 1.5 mm thicker than the first maximum thickness.

11. The ball bat of claim 1, wherein the inwardly projecting circumferential humps comprise a circumferential hump having a continuously variable thickness extending from a first end of the circumferential hump proximate the axial distal end of the barrel portion to a second end of the circumferential hump proximate the handle portion.

12. The ball bat of claim 1, wherein the ball bat has a bat-ball coefficient of restitution (BBCOR) that satisfies the NCAA BBCOR competition standard, a BBCOR value of no greater than 0.500.

13. The ball bat of claim 12, wherein the ball bat has a length of X inches and a weight of (X-3) ounces.

14. A ball bat comprising:

a handle portion;

an aluminum barrel portion extending away from the handle portion to an axial distal end, the aluminum barrel portion having an outer wall comprising:

a first inwardly projecting circumferential hump having a first maximum thickness and axially spaced from an axial end of the ball bat by no greater than 2.5 inches; and a second inwardly projecting circumferential hump having a second maximum thickness greater than the first maximum thickness and axially spaced from the axial distal end by at least 4 inches.

* * * * *